US006135545A

United States Patent [19]

Liao

[11] Patent Number: 6,135,545

[45] Date of Patent: Oct. 24, 2000

[54] MULTIFUNCTIONAL FURNITURE ASSEMBLY

[76] Inventor: Chin-Hsi Liao, P.O. Box 63-247, Taichung, Taiwan

[21] Appl. No.: 09/325,052

[22] Filed: Jun. 3, 1999

[51] Int. Cl.[7] ..... A47C 17/16

[52] U.S. Cl. ..... 297/124; 297/233; 297/354.13; 5/18.1; 5/37.1

[58] Field of Search ..... 297/118, 124, 297/233, 354.13, 236; 5/18.1, 37.1, 39

[56] References Cited

U.S. PATENT DOCUMENTS

| | | | |
|---|---|---|---|
| 1,421,929 | 7/1922 | Floreskul | 297/124 X |
| 2,329,914 | 9/1943 | Kost | 5/39 |
| 3,450,072 | 6/1969 | Farkas | 5/18.1 X |
| 3,743,351 | 7/1973 | Harris | 5/18.1 X |
| 5,956,785 | 9/1999 | Fireman | 5/37.1 |

*Primary Examiner*—Peter R. Brown
*Attorney, Agent, or Firm*—Alan Kamrath

[57] ABSTRACT

A furniture assembly includes four furniture units that can be assembled to form a bed, a table, or a chair. First and second furniture units are mounted juxtaposed to other yet allowing sliding movement relative to each other. Third and fourth furniture units are mounted juxtaposed to each other and behind the first and second furniture units, respectively. The third and fourth furniture units are also slidable relative to each other. The third and fourth furniture units may be pivoted relative to the first and second furniture units and then positioned to form a length-adjustable chair.

5 Claims, 14 Drawing Sheets

MULTIFUNCTIONAL FURNITURE ASSEMBLY

BACKGROUND OF THE INVENTION

1. Field of the Invention

The present invention relates to a multifunctional furniture assembly that may be used as a table, a bed, or a chair.

2. Description of the Related Art

Furniture such as tables, beds, and chairs have particular shapes and different functions. Users have to buy all of them for indoor use. Although an attempt for providing a bed/sofa combination has been made, the result is unsatisfactory and the function is still limited when considering outdoor use. The present invention is intended to provide a multifunctional furniture assembly that can be used as a table, a bed, or a chair.

SUMMARY OF THE INVENTION

It is a primary object of the present invention to provide a furniture assembly that can be used as a table, a bed, or a chair.

It is a secondary object to the present invention to provide a furniture assembly that is easy to carry for convenient outdoor use.

A furniture assembly in accordance with the present invention comprises:

a first furniture unit including:

a first side base with a first upper peg and a first lower peg formed on an inner side thereof, a supporting member spaced from the first side base, and a plurality of spaced first plates connected between the supporting member and a part of the side base;

a second furniture unit mounted juxtaposed to the first furniture unit and including:

two spaced second side bases each having a second upper peg and a second lower peg on an inner side thereof, a plurality of spaced second plates connected between a part of the side base and a part of the side base;

a third furniture unit mounted behind the first furniture unit and including:

a first adjusting member including a first slot therein for slidingly receiving the first upper peg of the first furniture unit, said first adjusting member further including a first notch in an end face of the other part thereof for disengagably receiving with the first lower peg of the first furniture unit;

a second supporting member spaced from the first adjusting member, and a plurality of spaced third plates connected between the second supporting member and a part of the first adjusting member, said third plates and said first plates being alternately disposed to allow relative sliding movements therebetween along a length direction, thereby allowing the first furniture unit and the second furniture unit to be movable between an extended status and a fully aligned status; and a fourth furniture unit mounted juxtaposed to the third furniture unit and behind the second furniture unit, the fourth furniture unit including:

two spaced second adjusting members each including a slot therein for slidingly receiving an associated said second upper peg of the second furniture unit, each said second adjusting member further including a second notch in an end face of a part thereof for disengagably receiving an associated said second lower peg of the second furniture unit, and a plurality of spaced fourth plates connected between the other part of one of the second adjusting members and the other part of the other second adjusting member, said third plates and said first plates being alternately disposed to allow relative sliding movements therebetween along a length direction, thereby allowing the first furniture unit and the second furniture unit to be movable between an extended status and a fully aligned status.

The furniture assembly forms a table when the first notch of the first adjusting member of the third furniture unit disengages from the first lower peg of the first furniture unit and when the first furniture unit and the third furniture unit as well as the second furniture unit and the fourth furniture unit are in their fully aligned status.

The furniture assembly forms a bed when the notch of the first adjusting member of the third furniture unit disengages from the first lower peg of the first furniture unit and when the first furniture unit and the third furniture unit as well as the second furniture unit and the fourth furniture unit are in their extended status.

The furniture assembly forms a chair when the second notch in each said second adjusting member of the fourth furniture unit engages with the associated second lower peg of the second furniture unit.

In a preferred embodiment of the invention, a furniture assembly comprises:

a first furniture unit including:

a first side base with a first upper peg and a first lower peg formed on an inner side thereof, a supporting member spaced from the first side base, and a plurality of spaced first plates connected between the supporting member and a part of the side base, each said first plate including a first groove track in a first lateral side thereof and a first rib on a second lateral side thereof;

a second furniture unit mounted juxtaposed to the first furniture unit and including:

two spaced second side bases each having a second upper peg and a second lower peg on an inner side thereof, a plurality of spaced second plates connected between a part of the side base and a part of the side base, each said second plate having a second track groove in a first lateral side thereof and a second rib on a second lateral side thereof;

a third furniture unit mounted behind the first furniture unit and including:

a first adjusting member including a first slot therein for slidingly receiving the first upper peg of the first furniture unit, said first adjusting member further including a first notch in an end face of the other part thereof for disengagably receiving with the first lower peg of the first furniture unit;

a second supporting member spaced from the first adjusting member, and a plurality of spaced third plates connected between the second supporting member and a part of the first adjusting member, each said third plate having a third groove in a first lateral side thereof for slidingly engaging with an associated said first rib of the first furniture unit, each said third plate further having a third rib on a second lateral side thereof for slidingly engaging with an associated said first groove track of the first furniture unit; and a fourth furniture unit mounted juxtaposed to the third furniture unit and behind the second furniture unit, the fourth furniture unit including:

two spaced second adjusting members each including a slot therein for slidingly receiving an associated said second upper peg of the second furniture unit, each said second adjusting member further including a second notch in an end face of a part thereof for disengagably receiving an associated said second lower peg of the second furniture unit, and a plurality of spaced fourth plates connected between the other part of one of the second adjusting members and the other part of the other second adjusting member, each said fourth plate having a fourth track groove in a first lateral side thereof for slidingly engaging with an associated said second rib of the second furniture unit, each said fourth plate further including a fourth rib on a second lateral side thereof for slidingly engaging with an associated said second groove track of the second furniture unit.

Other objects, advantages, and novel features of the invention will become more apparent from the following detailed description when taken in conjunction with the accompanying drawings.

DETAILED DESCRIPTION OF THE PREFERRED EMBODIMENT

Figure 2:
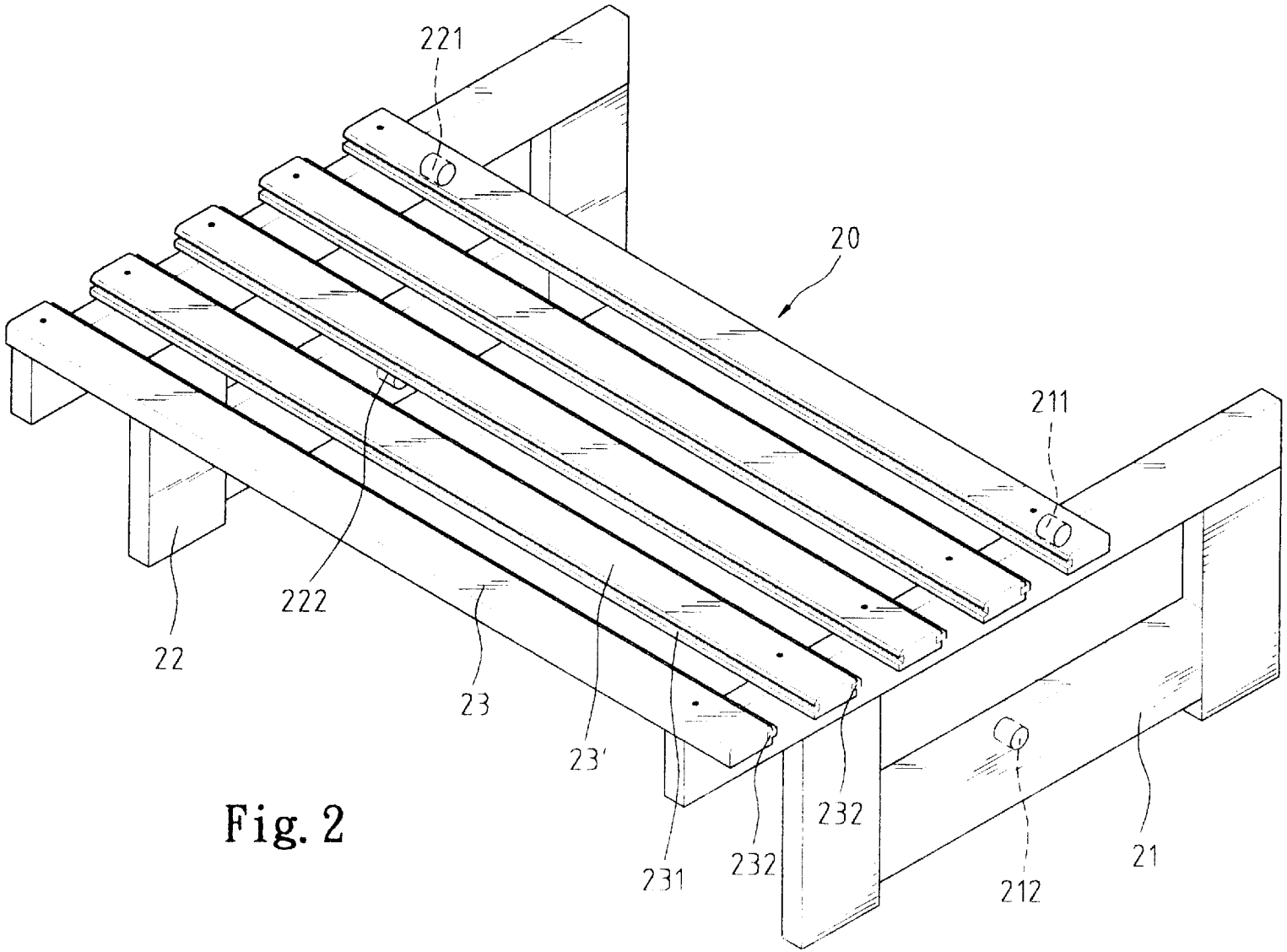
FIG. 2 is a perspective view of a second furniture unit of the furniture assembly in accordance with the present invention.
Figure 3:
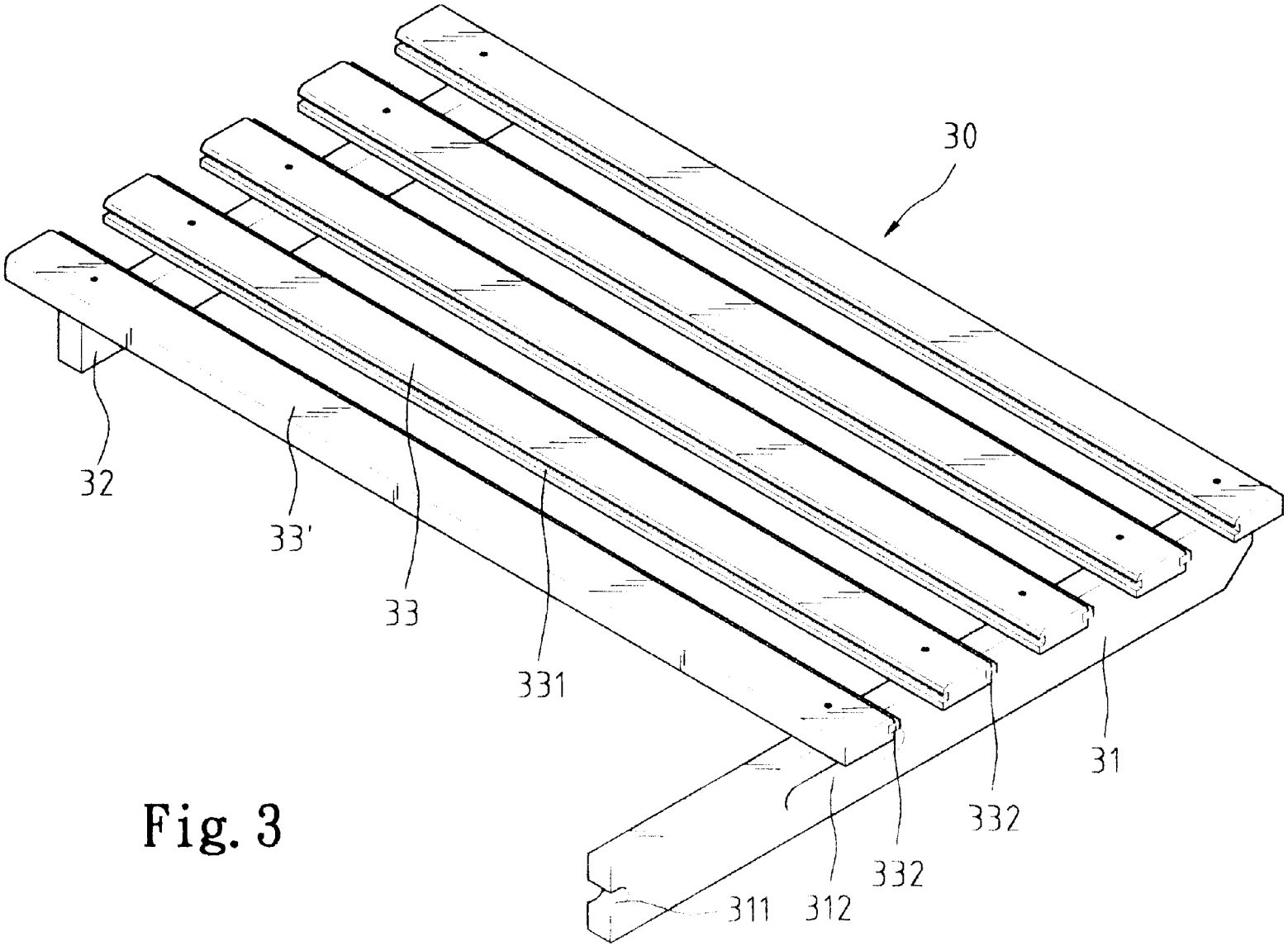
FIG. 3 is a perspective view of a third furniture unit of the furniture assembly in accordance with the present invention.
Figure 4:
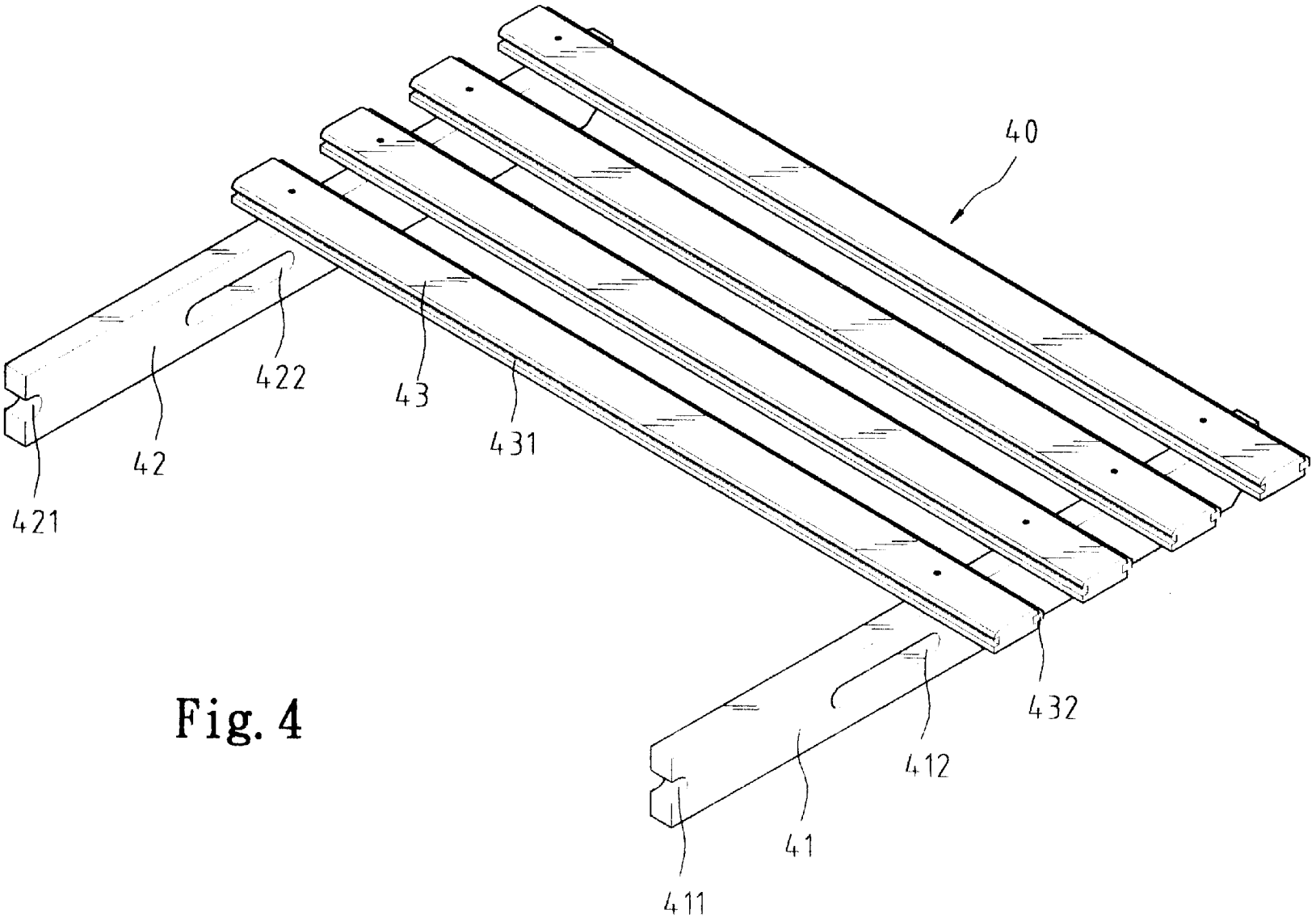
FIG. 4 is a perspective view of a fourth furniture unit of the furniture assembly in accordance with the present invention.

Referring to FIGS. 1 through 4, a furniture assembly in accordance with the present invention includes a first furniture unit 10 (FIG. 1), a second furniture unit 20 (FIG. 2), a third furniture unit 30 (FIG. 3), and a fourth furniture unit 40 (FIG. 4).

Figure 1:
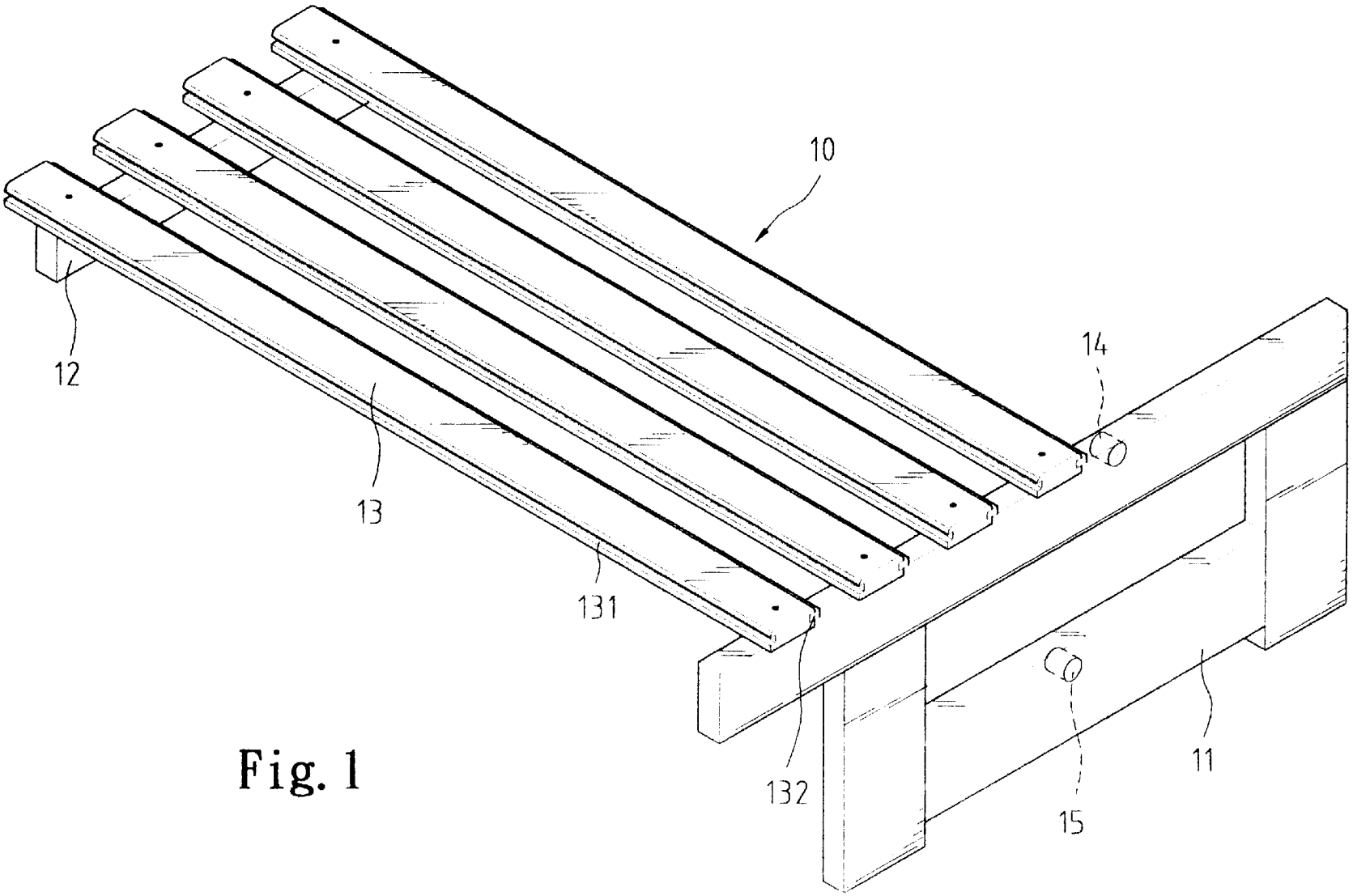
FIG. 1 is a perspective view of a first furniture unit of a furniture assembly in accordance with the present invention.

Referring to FIG. 1, the first furniture unit 10 includes a side base 11 with an upper peg 14 and a lower peg 15 formed on an inner side thereof. The first furniture unit 10 further includes a supporting member 12 spaced from the side base 11 and a number of spaced plates 13 connected between the supporting member 12 and a part of the side base 11. Each plate 13 includes a groove track 131 in a first lateral side thereof and a rib 132 on a second lateral side thereof.

Referring to FIG. 2, the second furniture unit 20 includes two side bases 21 and 22 each having an upper peg 211, 221 and a lower peg 212, 222 on an inner side thereof. A number of spaced plates 23 are connected between a part of the side base 21 and a part of the side base 22. Except the outermost plate 23' that has a rib 232 on an inner lateral side and a flat outer lateral side, each plate 23 has a track groove 231 in a first lateral side thereof and a rib 232 on a second lateral side thereof.

Referring to FIG. 3, the third furniture unit 30 includes an adjusting member 31, a supporting member 32 spaced from the adjusting member 31, and a number of spaced plates 33 connected between the supporting member 32 and a part of the adjusting member 32. The adjusting member 31 includes a slot 312 therein and a substantially U-shaped notch 311 in an end face of the other part thereof. Except the innermost plate 33' that has a rib 331 on an inner lateral side and a flat outer lateral side, each plate 33 has a track groove 331 in a first lateral side thereof and a rib 332 on a second lateral side thereof.

Referring to FIG. 4, the fourth furniture unit 40 includes two spaced adjusting members 41 and 42 and a number of spaced plates 43 connected between a part of the adjusting member 41 and a part of the adjusting member 42. Each plate 43 has a track groove 431 in a first lateral side thereof and a rib 432 on a second lateral side thereof. Each adjusting member 41, 42 includes a slot 412, 422 in the other part and a substantially U-shaped notch 411, 421 in an end face of the other part.

Figure 5:
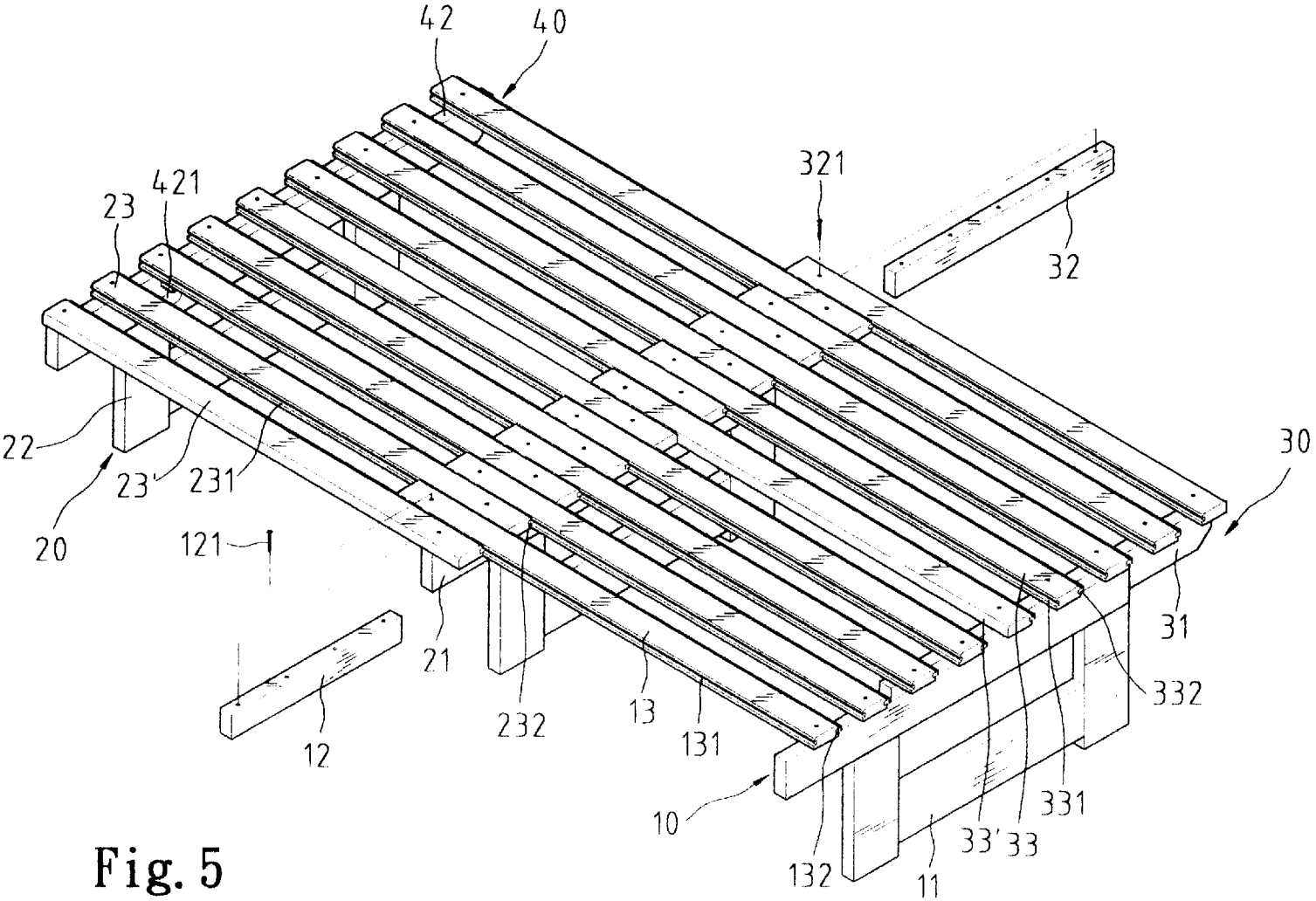
FIG. 5 is an exploded perspective view of the furniture assembly in accordance with the present invention.
Figure 6:
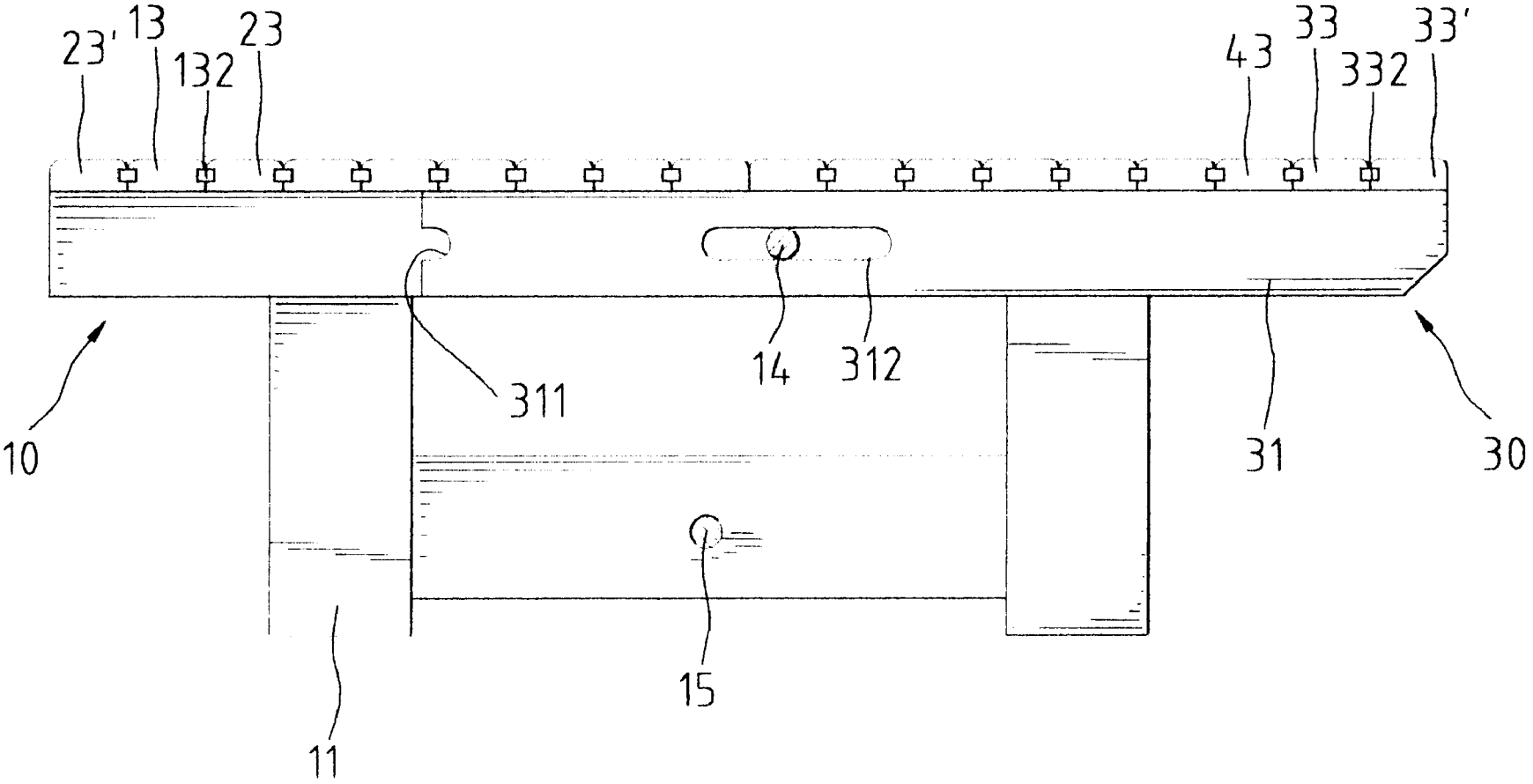
FIG. 6 is a side view of the furniture assembly in FIG. 6 after assembly.
Figure 7:
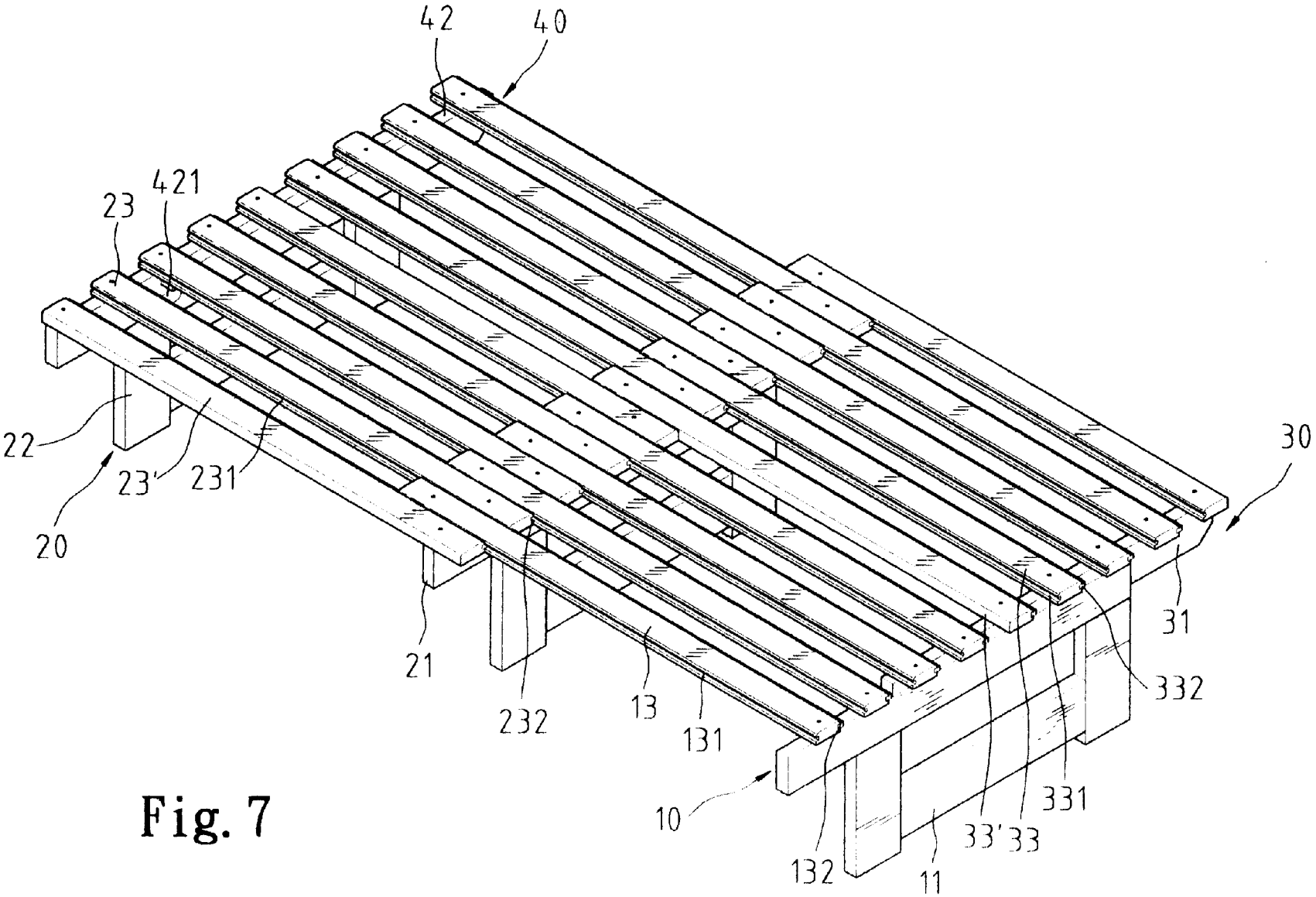
FIG. 7 is a perspective view of the furniture assembly adjusted to form a bed.
Figure 8:
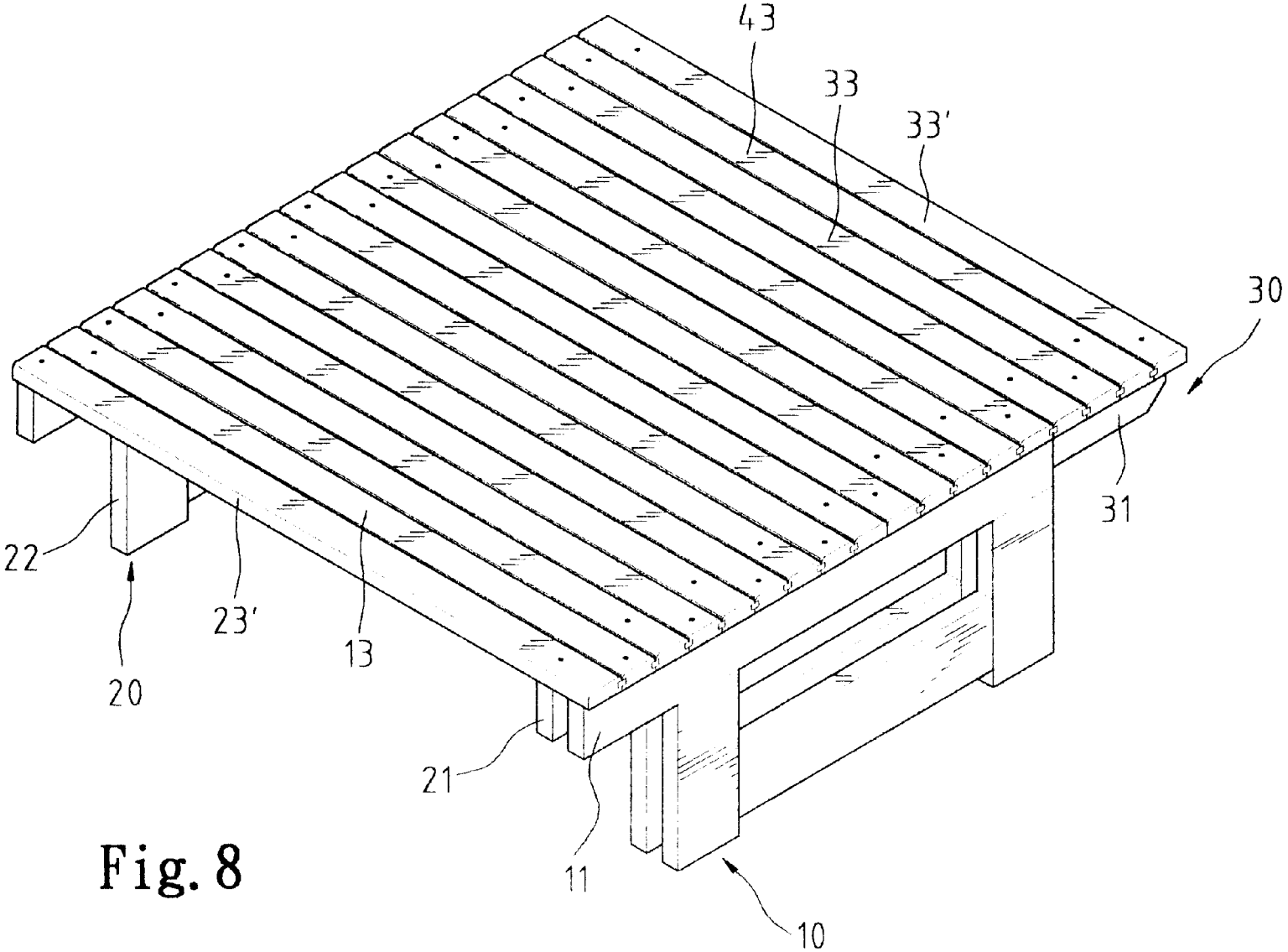
FIG. 8 is a perspective view of the furniture assembly adjusted to form a table.
Figure 13:
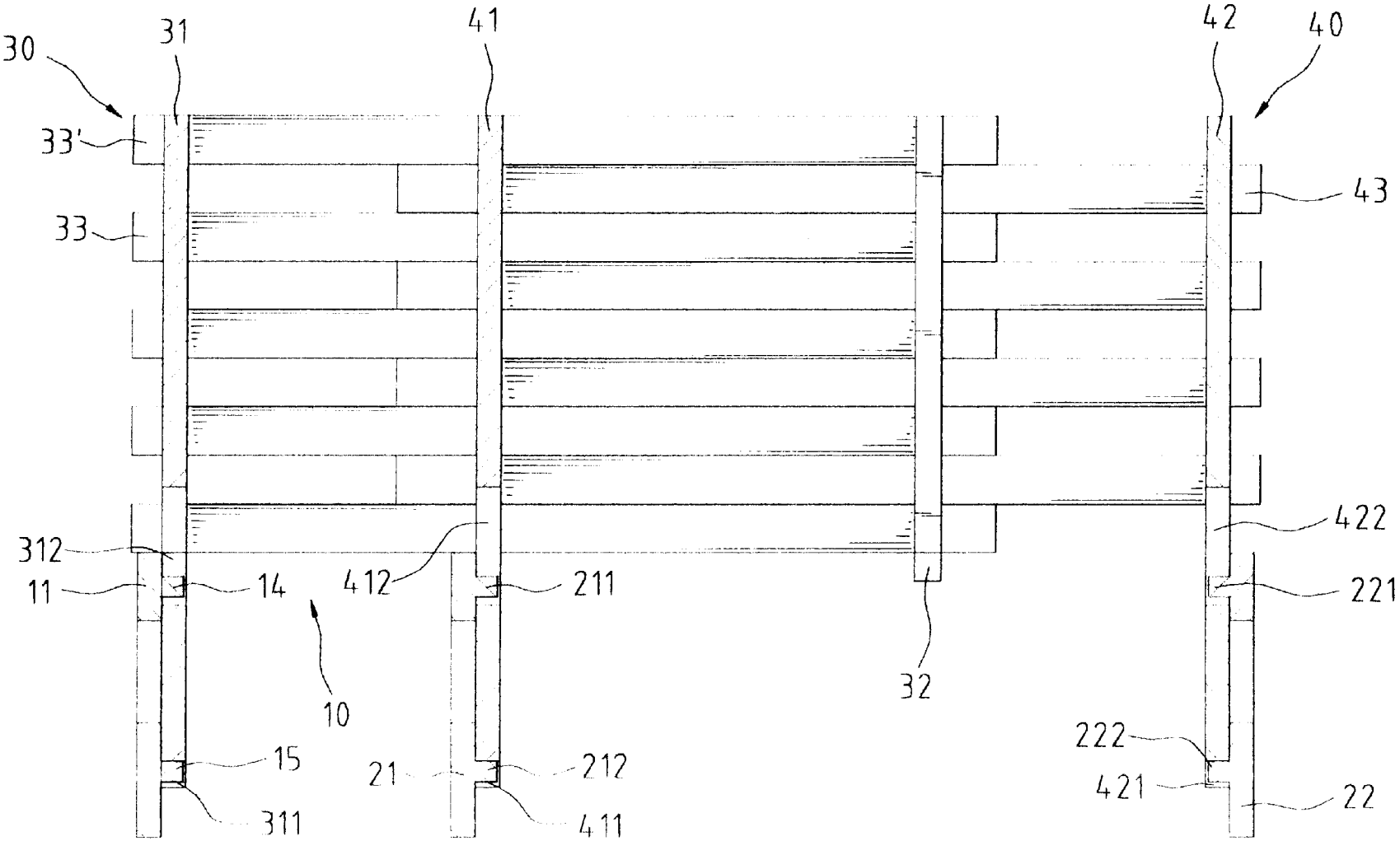
FIG. 13 is a partly sectioned rear view illustrating adjustment of the chair in length, wherein the backrest is also adjusted in length.

Referring to FIGS. 5 and 6, when assembling the furniture units, the fourth furniture unit 40 is placed behind the second furniture unit 20 and juxtaposed to the third furniture unit 30 that is placed behind the first furniture unit 10. Each rib 132, 232, 332, 432 is slidably received in an associated groove track 231, 131, 431, 331. Referring to FIG. 13, the pegs 211 and 221 of the second furniture unit 20 are slidably received in the slots 412 and 422 of the adjusting members 41 and 42 of the fourth furniture unit 40, respectively. The peg 14 of the first furniture unit 10 is slidably received in the slot 312 of the third furniture unit 30. The supporting members 12 and 32 are then fixed to the corresponding furniture units 10 and 30 by screws 121 and 321 (FIG. 5) or the like. Thus, the first/third furniture units 10 and 30 and the second/fourth furniture units 20 and 40 are slidable relative to each other along a length of the assembled furniture. FIG. 7 shows a bed formed by the furniture assembly in which the first/third furniture units 10 and 30 and the second/fourth furniture units 20 and 40 are in their fully extended status in the length. FIG. 8 shows a table formed by the furniture assembly in which the first/third furniture units 10 and 30 and the second/fourth furniture units 20 and 40 are in their fully aligned status in the length. It is appreciated that the spacing between the plates 13, 23, 33, 43 is arranged in a desired manner to allow fitting alignment between all of the plates when forming a table.

Figure 9:
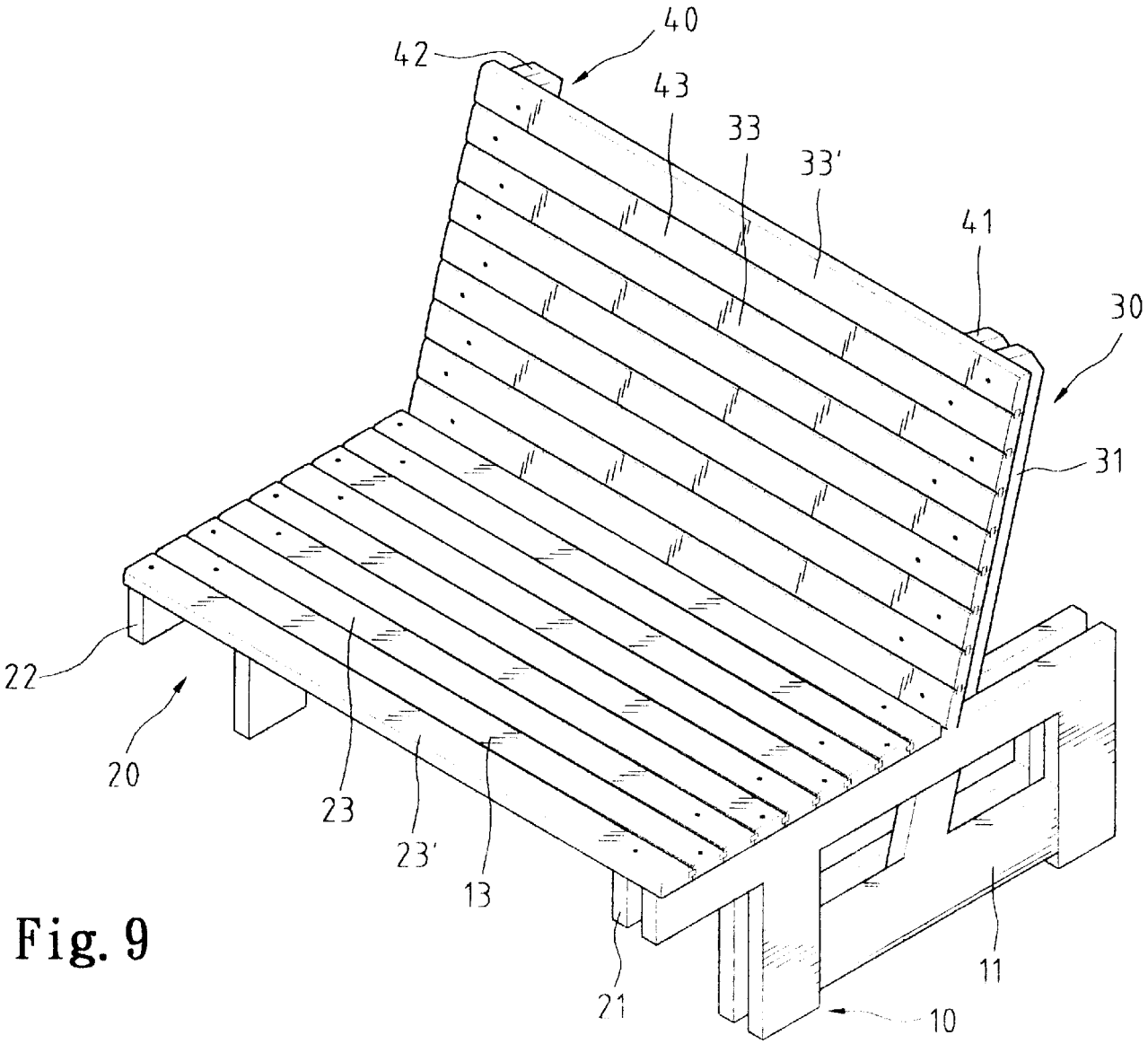
FIG. 9 is a perspective view of the furniture assembly adjusted to form a chair.
Figure 10:
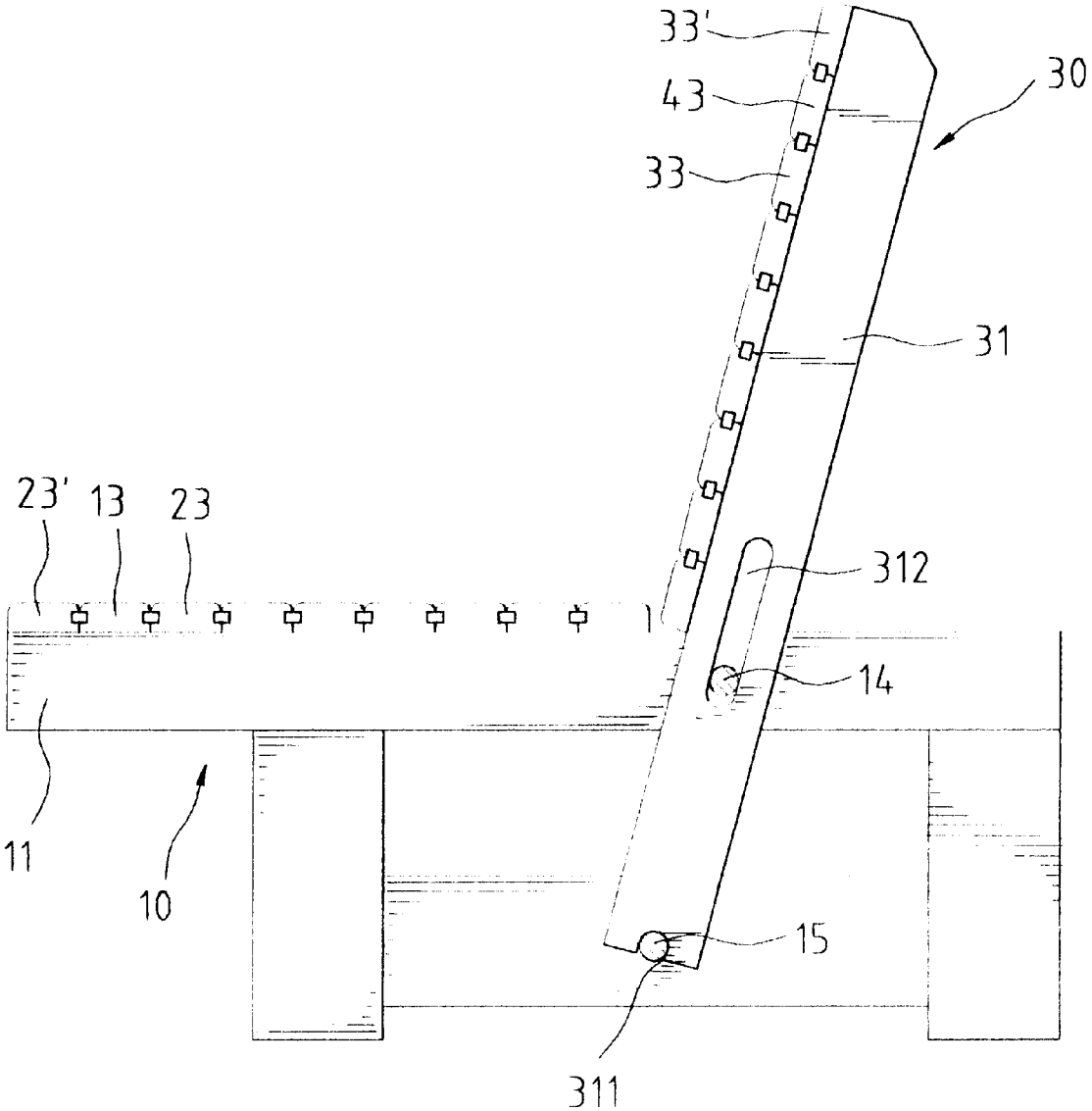
FIG. 10 is a side view of the chair in FIG. 9.
Figure 11:
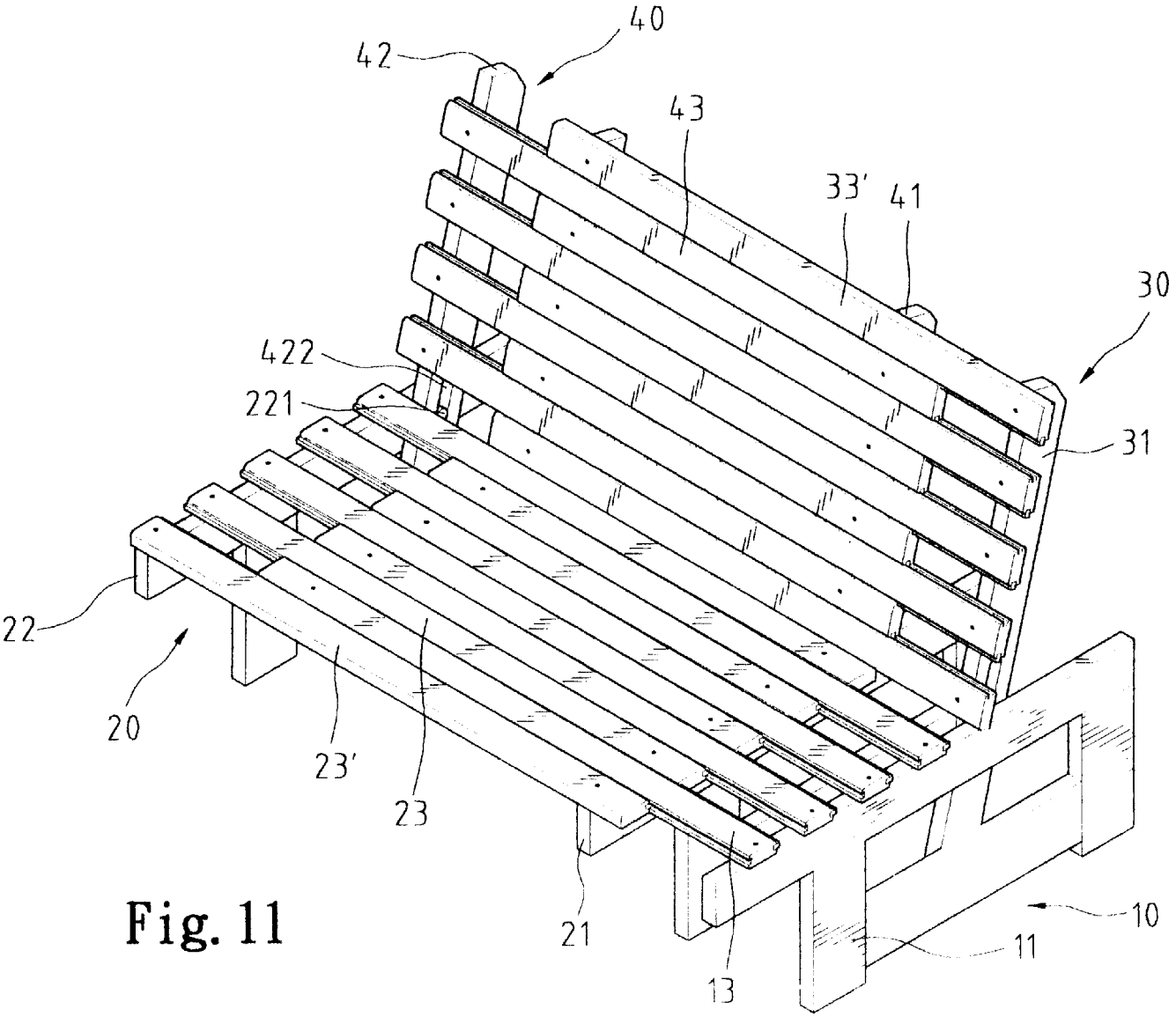
FIG. 11 is a perspective view of a chair having a longer length by means of adjusting the chair in FIG. 9.
Figure 12:
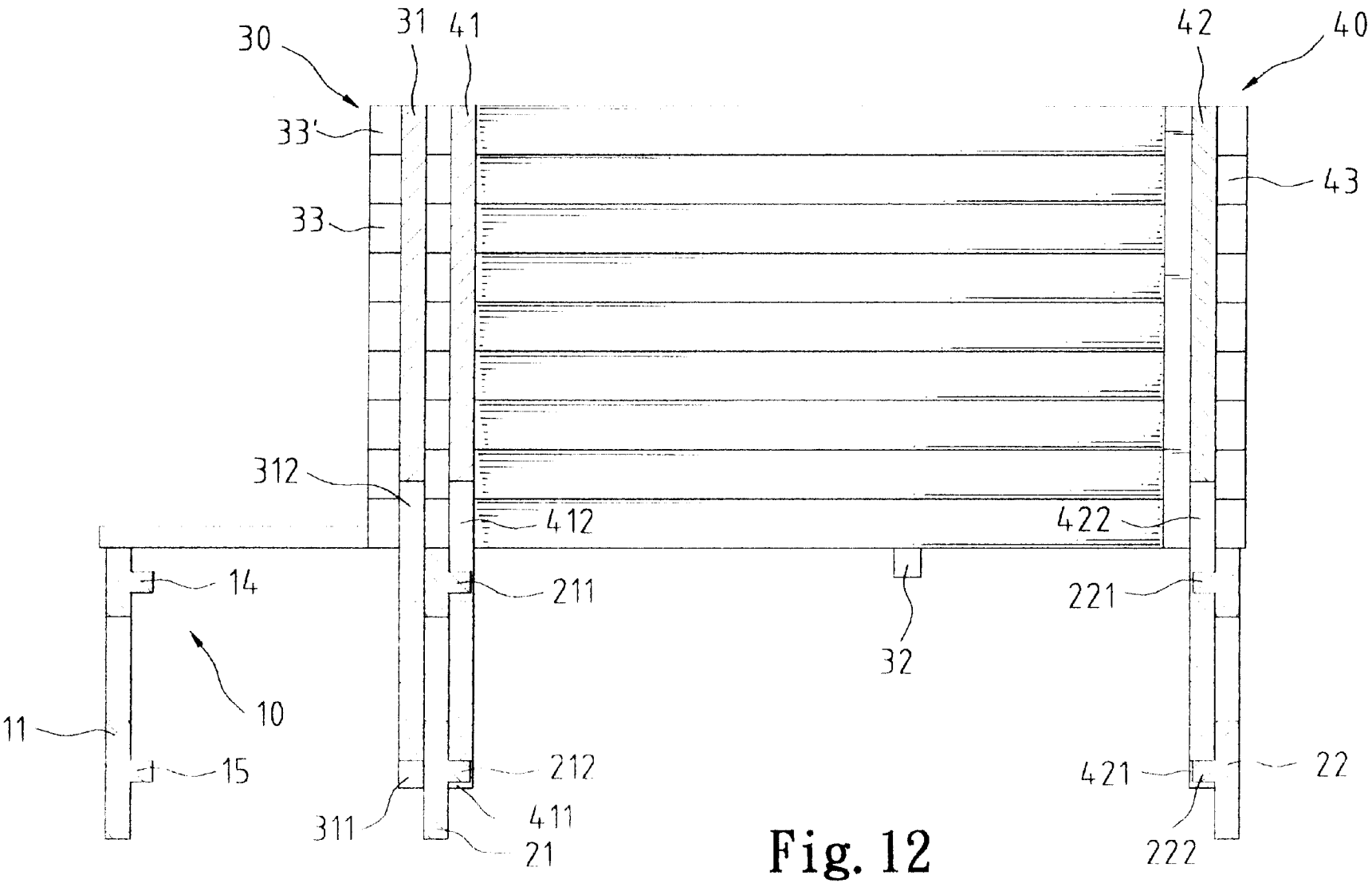
FIG. 12 is a partly sectioned rear view illustrating adjustment of the chair in length, yet the backrest remains unchanged.
Figure 14:
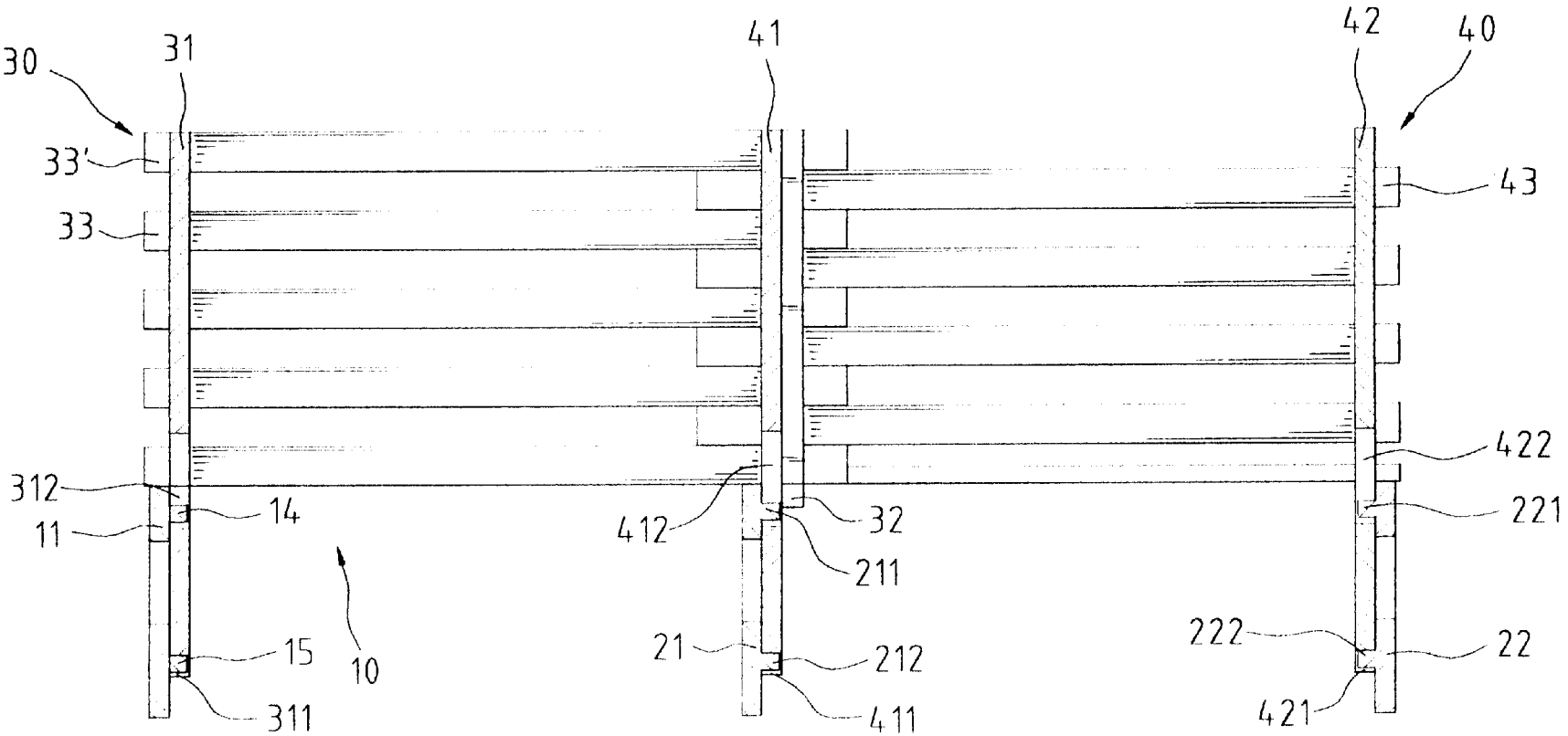
FIG. 14 is a partly sectioned rear view illustrating a bench formed by means of extending the chair to its full length.

Referring to FIGS. 9 and 10, the table in FIG. 8 may be adjusted to form a chair. The third/fourth furniture units 30 and 40 are moved away from the first/third furniture units 10 and 20 and then lifted and pivoted about the peg 14 to an inclined manner and then moved downward until the notch 311 of the third furniture unit 30 engages (receives) the peg 15 of the first furniture unit 10 and the notches 411 and 421 of the fourth furniture unit 40 engage (receive) the pegs 212 and 222 of the second furniture unit 20, respectively. Thus, a chair with an inclined backrest is formed. In addition, length adjustment of the chair is allowed by means of relative lengthwise sliding movement between the first/third furniture units 10 and 30 and the second/fourth furniture units 20 and 40. FIGS. 11, 13, and 14 show adjustment of the chair to form a bench in FIG. 14. Nevertheless, the chair can be adjusted in a manner that only the seat is adjusted, i.e., the backrest remains unchanged, as shown in FIG. 12.

According to the above description, it is appreciated that the furniture assembly in accordance with the present invention is multifunctional. It can be used as a table, chair, or bed, which is convenient both indoors and outdoors. In addition, the chair is adjustable in length. Carriage and storage of the furniture assembly are convenient.

Although the invention has been explained in relation to its preferred embodiment, it is to be understood that many other possible modifications and variations can be made without departing from the spirit and scope of the invention as hereinafter claimed.

What is claimed is:

1. A furniture assembly comprising:

a first furniture unit including:

a first side base with a first upper peg and a first lower peg formed on an inner side thereof, a supporting member spaced from the first side base, and a plurality of spaced first plates connected between the supporting member and a part of the side base;

a second furniture unit mounted juxtaposed to the first furniture unit and including:

two spaced second side bases each having a second upper peg and a second lower peg on an inner side thereof, a plurality of spaced second plates connected between a part of the side base and a part of the side base;

a third furniture unit mounted behind the first furniture unit and including:

a first adjusting member including a first slot therein for slidingly receiving the first upper peg of the first furniture unit, said first adjusting member further including a first notch in an end face of the other part thereof for disengagably receiving with the first lower peg of the first furniture unit;

a second supporting member spaced from the first adjusting member, and a plurality of spaced third plates connected between the second supporting member and a part of the first adjusting member, said third plates and said first plates being alternately disposed to allow relative sliding movements therebetween along a length direction, thereby allowing the first furniture unit and the second furniture unit to be movable between an extended status and a fully aligned status; and a fourth furniture unit mounted juxtaposed to the third furniture unit and behind the second furniture unit, the fourth furniture unit including:

two spaced second adjusting members each including a slot therein for slidingly receiving an associated said second upper peg of the second furniture unit, each said second adjusting member further including a second notch in an end face of a part thereof for disengagably receiving an associated said second lower peg of the second furniture unit, and a plurality of spaced fourth plates connected between the other part of one of the second adjusting members and the other part of the other second adjusting member, said third plates and said first plates being alternately disposed to allow relative sliding movements therebetween along a length direction, thereby allowing the first furniture unit and the second furniture unit to be movable between an extended status and a fully aligned status.

2. The furniture assembly as claimed in claim 1, wherein the furniture assembly forms a table when the first notch of the first adjusting member of the third furniture unit disengages from the first lower peg of the first furniture unit and when the first furniture unit and the third furniture unit as well as the second furniture unit and the fourth furniture unit are in their fully aligned status.

3. The furniture assembly as claimed in claim 1, wherein the furniture assembly forms a bed when the notch of the first adjusting member of the third furniture unit disengages from the first lower peg of the first furniture unit and when the first furniture unit and the third furniture unit as well as the second furniture unit and the fourth furniture unit are in their extended status.

4. The furniture assembly as claimed in claim 1, wherein the furniture assembly forms a chair when the second notch in each said second adjusting member of the fourth furniture unit engages with the associated second lower peg of the second furniture unit.

5. A furniture assembly comprising:

a first furniture unit including:

a first side base with a first upper peg and a first lower peg formed on an inner side thereof, a supporting member spaced from the first side base, and a plurality of spaced first plates connected between the supporting member and a part of the side base, each said first plate including a first groove track in a first lateral side thereof and a first rib on a second lateral side thereof;

a second furniture unit mounted juxtaposed to the first furniture unit and including:

two spaced second side bases each having a second upper peg and a second lower peg on an inner side thereof, a plurality of spaced second plates connected between a part of the side base and a part of the side base, each said second plate having a second track groove in a first lateral side thereof and a second rib on a second lateral side thereof;

a third furniture unit mounted behind the first furniture unit and including:

a first adjusting member including a first slot therein for slidingly receiving the first upper peg of the first furniture unit, said first adjusting member further including a first notch in an end face of the other part thereof for disengagably receiving with the first lower peg of the first furniture unit;

a second supporting member spaced from the first adjusting member, and a plurality of spaced third plates connected between the second supporting member and a part of the first adjusting member, each said third plate having a third groove in a first lateral side thereof for slidingly engaging with an associated said first rib of the first furniture unit, each said third plate further having a third rib on a second lateral side thereof for slidingly engaging with an associated said first groove track of the first furniture unit; and a fourth furniture unit mounted juxtaposed to the third furniture unit and behind the second furniture unit, the fourth furniture unit including:

two spaced second adjusting members each including a slot therein for slidingly receiving an associated said second upper peg of the second furniture unit, each said second adjusting member further including a second notch in an end face of a part thereof for disengagably receiving an associated said second lower peg of the second furniture unit, and a plurality of spaced fourth plates connected between the other part of one of the second adjusting members and the other part of the other second adjusting member, each said fourth plate having a fourth track groove in a first lateral side thereof for slidingly engaging with an associated said second rib of the second furniture unit, each said fourth plate further including a fourth rib on a second lateral side thereof for slidingly engaging with an associated said second groove track of the second furniture unit.

* * * * *